US009563145B2

(12) United States Patent
Kato

(10) Patent No.: US 9,563,145 B2
(45) Date of Patent: Feb. 7, 2017

(54) IMAGE FORMING APPARATUS

(71) Applicant: Oki Data Corporation, Tokyo (JP)

(72) Inventor: Ken Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/002,188

(22) Filed: Jan. 20, 2016

(65) Prior Publication Data

US 2016/0216681 A1 Jul. 28, 2016

(30) Foreign Application Priority Data

Jan. 28, 2015 (JP) ..... 2015-014261

(51) Int. Cl.
*G03G 15/02* (2006.01)
*G03G 15/00* (2006.01)

(52) U.S. Cl.
CPC ..... *G03G 15/0225* (2013.01); *G03G 15/0258* (2013.01); *G03G 15/55* (2013.01); *G03G 2215/0141* (2013.01)

(58) Field of Classification Search
CPC ..... G03G 15/0225; G03G 15/0258
See application file for complete search history.

(56) References Cited

U.S. PATENT DOCUMENTS 5,839,026 A * 11/1998 Ko ..... G03G 15/0225 399/100
7,031,629 B2 * 4/2006 Kawamura ..... G03G 15/065 399/149
2003/0194249 A1 * 10/2003 Kawamura ..... G03G 15/0225 399/100
2005/0078981 A1 * 4/2005 Ishiyama ..... G03G 15/0225 399/129
2008/0070149 A1 * 3/2008 Kato ..... G03G 9/0819 430/111.4
2009/0060554 A1 * 3/2009 Kosuge ..... G03G 15/0225 399/71
2015/0185681 A1 * 7/2015 Kosasa ..... G03G 15/0225 399/44

FOREIGN PATENT DOCUMENTS

JP 2009-098498 A 5/2009

* cited by examiner

*Primary Examiner* — David Gray
*Assistant Examiner* — Carla Therrien
(74) *Attorney, Agent, or Firm* — Muncy, Geissler, Olds & Lowe, P.C.

(57) ABSTRACT

An image forming apparatus includes an image carrier that carries a developer image formed by a developer including external additives, a charging member for charging the image carrier, a developer carrier that carries the developer, a developer supply member to which a supply voltage is applied for supplying the developer to the developer carrier, a main controller that controls an image formation mode for developing the developer image and controls a cleaning sequence mode for cleaning the charging member, and a voltage controller that changes outputs of the charging voltage, the development voltage and the supply voltage, and executes the cleaning sequence mode based on instructions of the main controller. When executing the cleaning sequence mode, the voltage controller makes an absolute value of the charging voltage larger than that in the image forming mode, and afterwards sets the output of the charging voltage to an OFF state.

19 Claims, 7 Drawing Sheets

IMAGE FORMING APPARATUS

CROSS REFERENCE TO RELATED APPLICATIONS

This application claims priority under 35 USC 119 to Japanese Patent Application No. 2015-014261 filed on Jan. 28, 2015, the entire contents which are incorporated herein by reference.

TECHNICAL FIELD

This invention relates to an image forming apparatus using an electrophotographic system or the like.

BACKGROUND

Conventionally, in an electrophotographic image forming apparatus, for example, the surface of a photosensitive drum as an image carrier is uniformly and evenly charged by a charging roller as a charging member. The charged surface of the photosensitive drum is exposed to light to form an electrostatic latent image. The formed electrostatic latent image is developed by having a toner adhere as a developer to form a toner image as a developer image. The formed toner image is transferred to a recording medium such as a print sheet and afterwards is fused by applying pressure and heat. The toner remaining on the photosensitive drum without being transferred to the recording medium is removed by a cleaning member.

In recent years, reducing the particle size and lowering the melting point of toners having external additives have been planned, aiming at improving the image quality and speed. As to such toners, because the amount of the external additives increases, cleaning is difficult. Therefore, the external additives adhere onto the charging roller, which generates longitudinal white streaks, and dirt in worse cases due to a charging failure. Then, proposed in Patent Document 1 is a method to remove the external additives by applying to the charging roller a charging voltage of the opposite polarity to that at the image forming time (or in the image forming mode).

PRIOR ART DOCUMENTS

[Patent Document 1] Japanese Unexamined Patent Application 2009-98498

However, there were following problems in a conventional image forming apparatus. If a charging voltage of the opposite polarity to that at the image forming time is applied to the charging roller, it becomes easier for the external additives of the opposite polarity to that of the toner to separate from the charging roller. However, because the surface potential of the photosensitive drum also comes to have the opposite polarity to that at the image forming time, the charge polarity of the external additives adhering to the charging roller and the charge polarity of the photosensitive drum surface become the same polarity. Therefore, there was a problem that the external additives adhering to the charging roller were difficult to migrate to the photosensitive drum.

SUMMARY

An image forming apparatus includes an image carrier that carries, on its surface, a developer image formed by a developer including external additives, a charging member to which a charging voltage is applied for charging the surface of the image carrier, a developer carrier that carries the developer and to which a development voltage is applied for forming the developer image on the surface of the image carrier, a developer supply member to which a supply voltage is applied for supplying the developer to the developer carrier, a main controller that controls an image formation mode for developing the developer image on a recording medium and controls a cleaning sequence mode that is other than the image formation mode and cleans the charging member, and a voltage controller that changes outputs of the charging voltage, the development voltage and the supply voltage, and executes the cleaning sequence mode based on instructions of the main controller.

When executing the cleaning sequence mode, the voltage controller makes an absolute value of the charging voltage larger than that in the image forming mode, and afterwards sets the output of the charging voltage to an OFF state.

According to the image forming apparatus of this invention, the cleaning sequence mode of the charging member is implemented after the image formation, and during this cleaning sequence mode, after making the absolute value of the charging voltage larger than that at the image forming time, the output of the charging voltage is set to the OFF state. Thereby, it becomes easier for the external additives that adhere onto the charging member and have the opposite polarity to that of the developer to move to the image carrier side, allowing the removal of the external additives adhering to the surface of the charging member without significantly decreasing the print throughput. Therefore, charge unevenness can be dissolved, and the image carrier is evenly charged, thereby a fine image can be formed. In the specification, the OFF state of output of the charging voltage means literally zero output. However, when considering sneak currents running into the charging member, the OFF state of output may be practically ranged between ∓10 volt.

DETAILED DESCRIPTION OF THE EMBODIMENTS

Embodiments of this invention will become clear if the following explanations on the preferred embodiments are read referring to attached drawings. Note that the drawings are only for the explanations and not for limiting the scope of this invention.

Embodiment 1

Configuration of Embodiment 1

Figure 1:
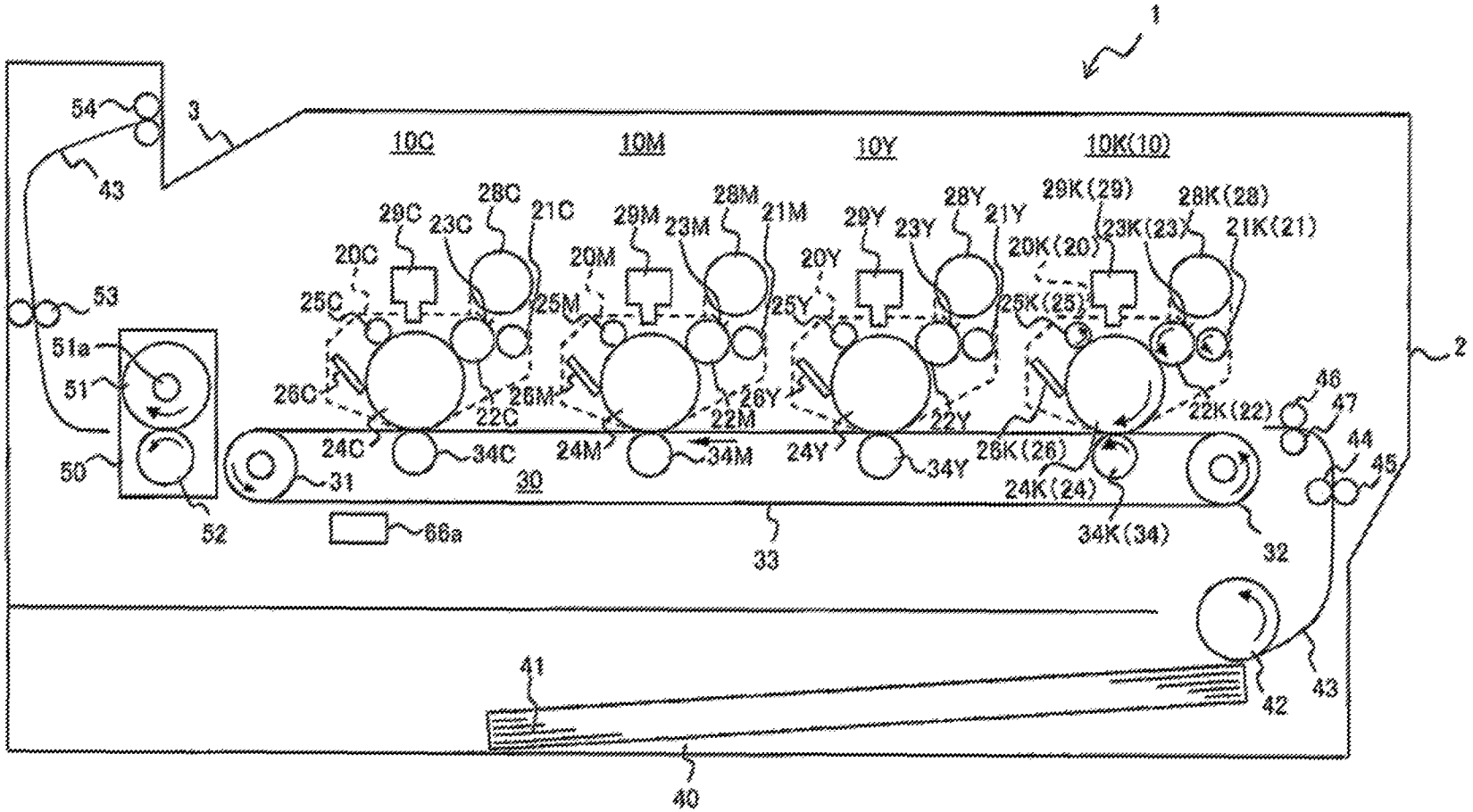
FIG. 1 is a schematic configuration diagram showing an image forming apparatus in Embodiment 1 of this invention.

FIG. 1 is a schematic configuration diagram showing an image forming apparatus in Embodiment 1 of this invention.

This image forming apparatus 1 is, for example, a color printer that forms a color image using an electrophotographic system and comprises an apparatus body 2 that is its chassis. Installed on the upper cover of the apparatus body 2 is a stacker part 3. In the upper portion inside the apparatus body 2, multiple image forming units 10 are attached in a detachable manner. Provided as the multiple image forming units 10 are, for example, image forming units 10K, 10Y, 10M, and 10C for black K, yellow Y, magenta M, and cyan C. The individual image forming units 10 (=10K, 10Y, 10M, and 10C) are sequentially arranged from the upstream side to the downstream side (from the right to the left in FIG. 1) along a medium carrying path 43 of a recording medium 41 such as a print sheet.

Each of the image forming units 10 (=10K, 10Y, 10M, and 10C) comprises a development unit 20, a toner cartridge 28, and an exposure head 29 as an exposure device. Provided as the development units 20 are, for example, development units 20K, 20Y, 20M, and 20C that respectively form black K, yellow Y, magenta M, and cyan C images. Provided as the toner cartridges 28 are, for example, toner cartridges 28K, 28Y, 28M, and 28C for black K, yellow Y, magenta M, and cyan C. Further, provided as the exposure heads 29 are, for example, exposure heads 29K, 29Y, 29M, and 29C for black M, yellow Y, magenta M, and cyan C.

Each of the development units 20 (=20K, 20Y, 20M, and 20C) comprises a supply roller 21 as a developer supply member that supplies a toner as the developer, a development roller 22 as a developer carrier that carries the supplied toner, a development blade 23 as a developer regulation member that regulates the thickness of a toner layer formed on the surface of this development roller 22.

Provided as the supply rollers 21 are, for example, supply rollers 21K, 21Y, 21M, and 21C for black K, yellow Y, magenta M, and cyan C. Provided as the development rollers 22 are, for example, development rollers 22K, 22Y, 22M, and 22C for black K, yellow Y, magenta M, and cyan C. Further, provided as the development blades 23 are, for example, development blades 23K, 23Y, 23M, and 23C for black K, yellow Y, magenta M, and cyan C.

Each of the development units 20 (=20K, 20Y, 20M, and 20C) is further provided with a photosensitive drum 24 as an image carrier that carries a toner image as a developer image, a charging roller 25 as a charging member, and a cleaning blade 26 as a cleaning member. Provided as the photosensitive drums 24 are, for example, photosensitive drums 24K, 24Y, 24M, and 24C for black K, yellow Y, magenta M, and cyan C. Provided as the charging rollers 25 are, for example, charging rollers 25K, 25Y, 25M, and 25C for black K, yellow Y, magenta M, and cyan C. Further, provided as the cleaning blades 26 are, for example, cleaning blades 26K, 26Y, 26M, and 26C for black K, yellow Y, magenta M, and cyan C.

To the development units 20 (=20K, 20Y, 20M, and 20C), the toner cartridges 28 as developer containers for supplying toners are attached, respectively, in a detachable manner. Provided as the toner cartridges 28 are, for example, the toner cartridges 28K, 28Y, 28M, and 28C for black K, yellow Y, magenta M, and cyan C. The toners supplied from the toner cartridges 28 (=28K, 28Y, 28M, and 28C) are supplied to the respective supply rollers 21 inside the respective development units 20. Each of the supply rollers 21 rotates in the counterclockwise direction of an arrow in FIG. 1. Contacting with each of the supply rollers 21 is the development roller 22 that rotates in the counterclockwise direction of an arrow in FIG. 1. Contacting with the outer-circumference face of each of the development rollers 22 is the development blade 23. Further, contacting with each of the development rollers 22 is the photosensitive drum 24 that rotates in the clockwise direction of an arrow in FIG. 1.

Each of the photosensitive drums 24 is a drum-shape member provided with a photosensitive layer on the surface of a conductive supporting body. Disposed around each photosensitive drum 24 is a charging roller 25 that uniformly charges the surface of this photosensitive drum 24, an exposure head 29 that forms an electrostatic latent image by irradiating the surface of the photosensitive drum 24 with light, the development roller 22 that develops the electrostatic latent image using a toner, and a cleaning blade 26 that scratches off the toner remaining on the surface of the photosensitive drum 24.

Disposed in the lower side of the multiple image forming units 10 (=10K, 10Y, 10M, and 10C) is a transfer device 30. The transfer device 30 comprises a belt drive roller 31, a belt driven roller 32, a carrying belt 33 that is an endless belt, and multiple transfer rollers 34 as transfer members. Provided as the multiple transfer rollers 34 are, for example, transfer rollers 34K, 34Y, 34M, and 34C for black K, yellow Y, magenta M, and cyan C.

The belt drive roller 31 is disposed in the side of the cyan C image forming unit 10C, and the belt driven roller 32 is disposed in the side of the black K image forming unit 10K. Between the belt drive roller 31 and the belt driven roller 32, the carrying belt 33 is stretched. The belt drive roller 31 is a roller that has the carrying belt 33 run, and the belt driven roller 32 is a roller that gives a constant tension to the carrying belt 33. By the belt drive roller 31 rotating, the carrying belt 33 runs, and a recording medium 41 such as a print sheet is held by being adsorbed onto the surface of this carrying belt 33 and carried. The transfer rollers 34 are disposed inside the carrying belt 33 in such a manner as to oppose their respective photosensitive drums 24. Applied to the transfer rollers 34 is a transfer voltage for transferring toner images formed on the respective photosensitive drums 24 to the recording medium 41 by the Coulomb force.

Below the carrying belt 33, a density sensor 66*a* is disposed opposing it. The density sensor 66*a* reads out the density of a print pattern printed on the surface of the carrying belt 33.

Detachably attached in the lower portion inside the apparatus body 2 is a sheet feeding cassette 40 as a medium accommodating part for accommodating multiple pieces of the recording medium 41 in a stacked state. Arranged in the upper side of the front end of the sheet feeding cassette 40 is a hopping roller 42 as a sheet feeding means for forwarding the recording medium 41 inside this sheet feeding cassette 40. The hopping roller 42 is disposed in such a manner as to contact with the surface of the top recording medium 41 inside the sheet feeding cassette 40, and it forwards the recording medium 41 to the medium carrying path 43 side by rotating.

In the downstream side of the hopping roller 42, a registration roller pair 44 and 45 and a carrying roller pair 46 and 47 are disposed along the medium carrying path 43. The registration roller pair 44 and 45 is a member that carries the recording medium 41 toward the carrying roller pair 46 and 47 while correcting the skew of the recording medium 41 by starting rotation after a certain wait time passed since the recording medium 41 reached the nip part (hereafter called the "NIP part") of this registration roller pair 44 and 45. The carrying roller pair 46 and 47 is a member that carries the recording medium 41 carried from the registration roller pair 44 and 45 toward the multiple image forming units 10 (=10K, 10Y, 10M, and 10C).

In the downstream side of the cyan C image forming unit 10C, a fuser device 50 is provided along the medium carrying path 43. The fuser device 50 applies pressure and heat to the recording medium 41, to which toner images are transferred, to fuse the toner image on the recording medium 41. The fuser device 50 is provided with a fuser roller 51 having a built-in heater 51*a* such as a halogen lamp for heating the recording medium 41, and a fuser backup roller 52 as a pressure roller that applies pressure to the recording medium 41 between itself and this fuser roller 51. In the downstream side of the fuser device 50, an ejection roller group 53 and 54 is disposed along the medium carrying path 43. The ejection roller group 53 and 54 is a member that ejects the recording medium 41, to which toner images are fused, to the stacker part 3 provided on the top cover of the apparatus body 2 for placing the recording medium.

Figure 2:
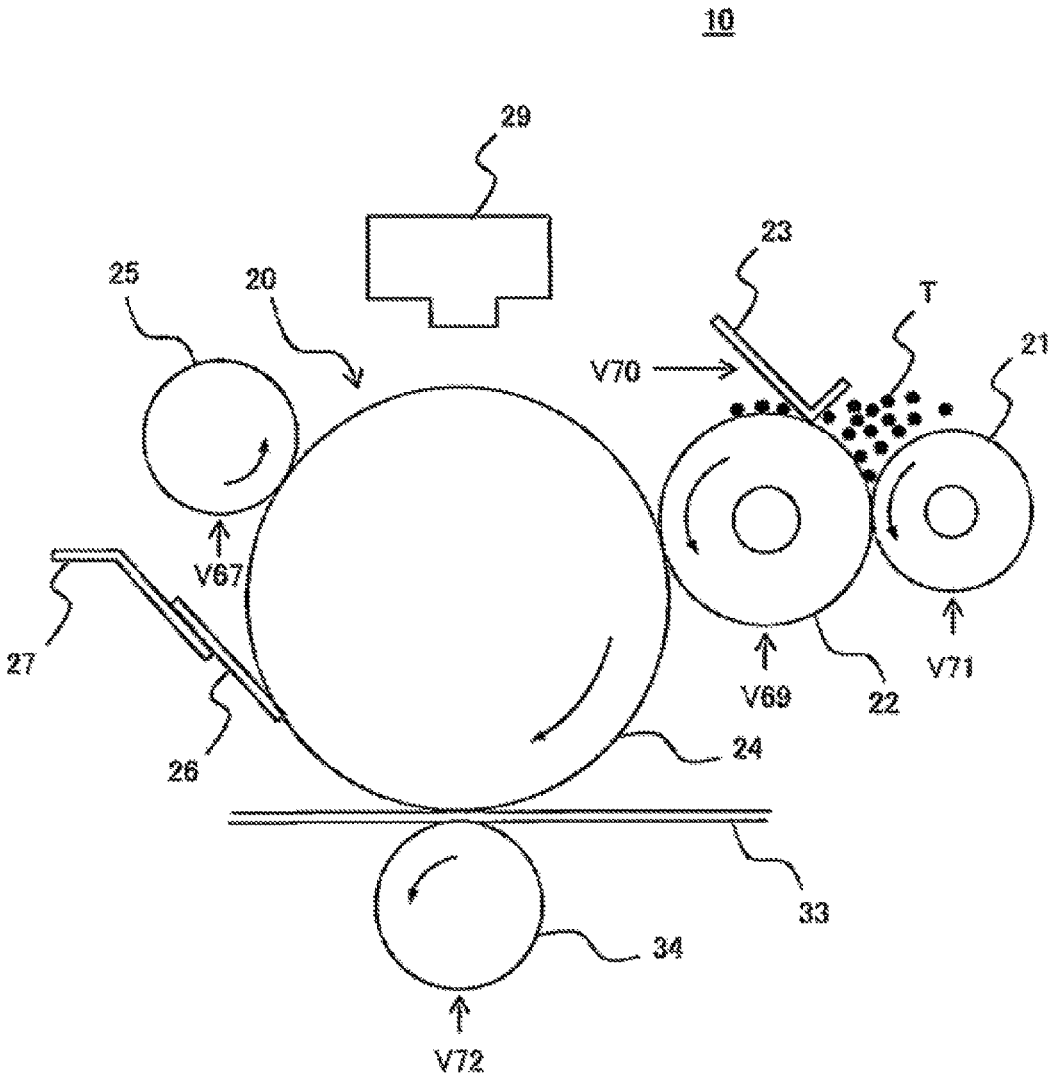
FIG. 2 is a configuration diagram showing one of individual image forming units 10 in FIG. 1.

FIG. 2 is a configuration diagram showing an individual image forming unit 10 in FIG. 1. The supply roller 21 is a member that supplies a toner T ejected from the toner cartridge 28 to the development roller 22, provided in such a manner as to contact with the surface of the development roller 22, and rotates in the same direction as the rotation direction of the development roller 22 (that is, in such a manner that the moving directions of their opposing surfaces become opposite to each other). The supply roller 21 is made by, for example, forming semiconductive urethane rubber on the surface of a metallic shaft. To the supply roller 21, a supply voltage V71 is applied by a supply voltage controller for supplying the toner T to the development roller 22.

The development roller 22 is provided in such a manner as to contact with the surface of the photosensitive drum 24 and rotates in the opposite direction to the rotation direction of this photosensitive drum 24 (that is, in such a manner that the moving direction of their surfaces in the opposing parts become the same). The development roller 22 is made by, for example, forming semiconductive urethane rubber on the surface of a metallic shaft. To the development roller 22, a development voltage V69 is applied by a development voltage controller for developing an electrostatic latent image on the surface of the photosensitive drum 24.

The development blade 23 is made by, for example, bending a long, plate-shaped member made of stainless steel in such a manner that its cross section perpendicular to the long-portion direction becomes approximately an L shape. The development blade 23 is disposed in such a manner that the outer face of the bent portion contacts with the surface of the development roller 22. Applied to the development blade 23 is a blade voltage V70 by a blade voltage controller for controlling the amount of charge of the toner layer on the development roller 22.

The photosensitive drum 24 comprises a cylindrical conductive supporting body and a photosensitive layer formed on the surface of this conductive supporting body. The conductive supporting body can be constituted of, for example, a metallic material such as aluminum, aluminum alloy, stainless steel, copper, and nickel, a resin material with a conductive power (such as metal, carbon, and tin oxide) added, or the like. In this Embodiment 1, the conductive supporting body is formed of a metallic material (such as aluminum). The photosensitive layer can be constituted of a single-layer photosensitive layer (single layer type photosensitive layer) where a photoconductive material is dissolved or dispersed in a binder resin, or a stacked photosensitive layer where a charge generation layer containing a charge generation substance and a charge transportation layer containing a charge transportation substance are stacked. The single-layer photosensitive layer is positively chargeable, and the stacked photosensitive layer is negatively chargeable. In this Embodiment 1, the stacked photosensitive layer is used. In the case of the stacked photosensitive layer, an undercoating layer is further formed between the surface of the conductive supporting body and the photosensitive layer. The undercoating layer is made by dispersing particles of a metal oxide (such as titanium oxide) or the like in a binder resin and is provided for improving the adhesiveness and blocking property.

The photosensitive drum 24 is made by, for example, sequentially forming the undercoating layer, the charge generation layer, and the charge transportation layer on the surface of the conductive supporting body by the dip coating method, the spray coating method, the blade coating method, or the like. In this Embodiment 1, the dip coating method is used. In the dip coating method, the undercoating layer is formed on the surface of the conductive supporting body by dipping the conductive supporting body in an application liquid where metal oxide particles are dispersed in a solution with a binder resin (for example, epoxy resin, polyethylene resin, etc.) dissolved, and afterwards pulling up the conductive supporting body from the application liquid and drying it. Next, the charge generation layer is formed on the surface of the undercoating layer by dipping the conductive supporting body in an application liquid where a charge generation substance is dispersed in a solution where a binder resin (for example, polyvinyl butyral resin, polyvinyl formal resin, etc.) is dissolved, and afterwards pulling up the conductive supporting body from the application liquid and drying it. Further, the charge transportation layer is formed on the surface of the charge generation layer by dipping the conductive supporting body in an application liquid where a charge transportation substance is dispersed in a solution with a binder resin (for example, polyvinyl butyral resin, polyvinyl formal resin, etc.) dissolved, and afterwards pulling up the conductive supporting body from the application liquid and drying it. In this Embodiment 1, the outer diameter of the photosensitive drum 24 is set to 30 mm, and the film thickness of the photosensitive layer (the charge generation layer and the charge transportation layer) is set to 28 μm as an example.

The charging roller 25 is provided in such a manner as to contact with the surface of the photosensitive drum 24 and rotates following the rotation of this photosensitive drum 24. The charging roller 25 is made by, for example, forming semiconductive epichlorohydrin rubber on the surface of a metallic shaft. Applied to the charging roller 25 is a charging voltage V67 for uniformly charging the surface of the photosensitive drum 24.

The exposure head 29 disposed in the vicinity of the photosensitive drum 24 is provided with, for example, a light emitting element array where multiple light emitting diodes (hereafter called "LED"s) are arranged in one direction, and a lens array where multiple lenses are arranged in one direction. The exposure head 29 is configured in such a manner as to focus light emitted from individual LEDs onto the surface of the photosensitive drum 24 by the lenses.

The cleaning blade 26 is disposed between the NIP part between the transfer roller 34 and the photosensitive drum 24 and the NIP part between the charging roller 25 and the photosensitive drum 24 in the rotation direction of the photosensitive drum 24. By its tip part being pressed on the surface of the photosensitive drum 24, the cleaning blade 26 scrapes off a transfer residual toner remaining on the surface of this photosensitive drum 24. The cleaning blade 26 is, for example, an elongated member that is long along the axial direction of the photosensitive drum 24 and formed of an elastic member such as rubber (for example, urethane rubber). The cleaning blade 26 is fixed by a blade holder 27 to the main body of the image forming unit 10. Besides, although in the example shown in FIG. 2 the blade holder 27 comprises a horizontal part extending horizontally and a slope part that is sloped obliquely downwards (toward the outer circumference of the photosensitive drum 24), it is not limited to such a shape but can be a plate-shape member for example.

The transfer roller 34 is provided in such a manner as to sandwich the carrying belt 33 between itself and the photosensitive drum 24 and rotates following the rotation of that photosensitive drum 24. The transfer roller 34 is made by, for example, forming foam rubber such as acrylonitrile-butadiene rubber (NBR) on the surface of a metallic shaft. Applied to the transfer roller 34 is a transfer voltage V72 by the transfer voltage controller for transferring a toner image on the surface of the photosensitive drum 24 to the recording medium 41.

In the image forming apparatus 1 of this Embodiment 1, for example, a nonmagnetic single-component developer is used as the toner T. The toner T is a polymerized toner, and its average particle size is 6 μm. The toner T comprises mother particles containing a resin and a coloring agent at least, and external additives added (externally added) to the surface of the mother particles. The mother particles are manufactured by the emulsion polymerization method. The average particle size of the external additives is 5-400 nm. Also, the amount of the external additives for 100 pts. wt. of the mother particles should preferably be 0.5-8.0 pts. wt., more preferably 1.5-6.0 pts. wt., and even more preferably 1.5-5.0 pts. wt.

The toner T in this Embodiment 1 comprises, as external additives, melanin, medium-size silica, organic fine particles, and silica spacer. The average particle size of melanin is 100-300 nm, and the average particle size of the medium-size silica is 5-40 nm. The average particle size of the organic fine particles is 100-400 nm, and the average particle size of the silica spacer is 100 nm. The above-mentioned content (pts. wt.) of the external additives can be obtained from the ratio of the spectral intensity obtained by analyzing the toner composition using the energy dispersive X-ray spectrometry (EDX), FT-IR, or the like, and the spectral intensity obtained when the external additives are added by known parts by weight. The ratio of the spectral intensities and the content (pts. wt.) have a proportional relationship.

Figure 3:
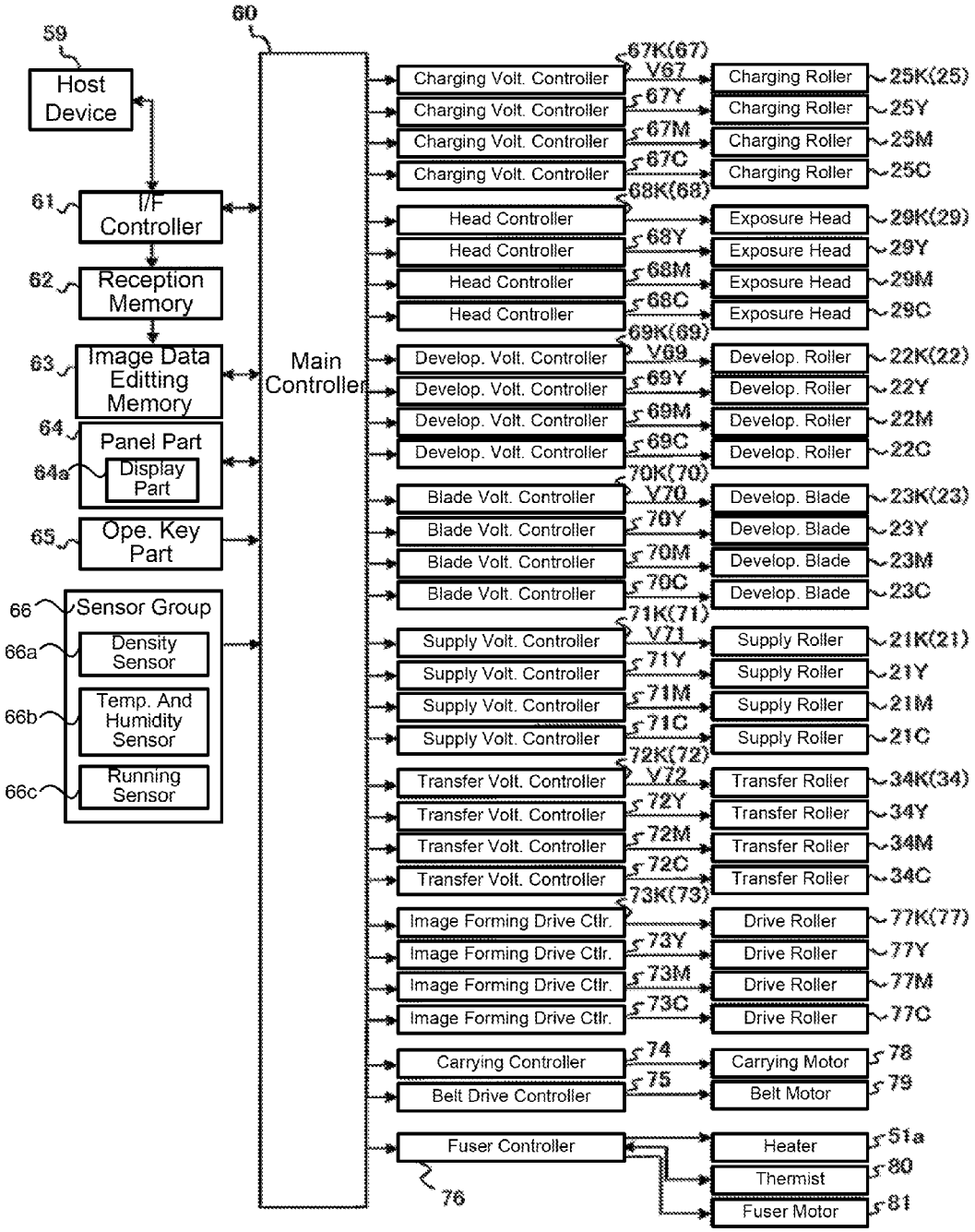
FIG. 3 is a block diagram showing the configuration of a control system in the image forming apparatus 1 in FIG. 1.

FIG. 3 is a block diagram showing the configuration of a control system in the image forming apparatus 1 in FIG. 1. The control system of the image forming apparatus 1 comprises a main controller 60. The main controller 60 is the one that, for example, receives print data and control commands through an interface (hereafter called "I/F") controller 61 from a host device 59 such as a personal computer, and program-controls the whole print (that is, image formation) operation of the image forming apparatus 1. The main controller 60 is constituted of, for example, a microprocessor, ROM (Read Only Memory), RAM (Random Access Memory), input/output ports, a timer, etc.

Connected to the main controller 60 are, other than the above-mentioned I/F controller 61, image data editing memory 63, a panel part 64, an operation key part 65, and a sensor group 66. Connected between the I/F controller 61 and the image data editing memory 63 is reception memory 62.

The I/F controller 61 has a function to transmit information on the image forming apparatus 1 (printer information) to the host device 59 and analyze the control commands received from the host device 59 or process the print data received from the host device water vapor amount 59. The reception memory 62 temporarily stores, for each color, the print data input from the host device through the I/F controller 61. The image data editing memory 63 edits and stores, as image data, the print data stored temporarily in the reception memory 62. The panel part 64 comprises a display part 64*a* comprising LEDs etc. for displaying the state of the image forming apparatus 1. The operation key part 65 is a part for an operator to input instructions to the image forming apparatus 1. The sensor group 66 comprises various kinds of sensors (for example, a density sensor 66*a* for density measurements, a temperature and humidity sensor 66*b* as a detection means, and running sensors 66*c* as multiple medium position sensors to detect the carrying position of the recording medium 41, etc.) for monitoring the operation state of the image forming apparatus 1. The output signals of the sensor group 66 are input to the main controller 60.

Further connected to the main controller 60 are multiple charging voltage controllers 67, multiple head controllers 68, multiple development voltage controllers 69, multiple blade voltage controllers 70, multiple supply voltage controllers 71, multiple transfer voltage controllers 72, multiple image forming drive controllers 73, a carrying controller 74, a belt drive controller 75, and a fuser controller 76. The voltage controller is configured of multiple charging voltage controllers 67, multiple development voltage controllers 69, and multiple supply voltage controllers 71.

The multiple charging voltage controllers 67 comprise, for example, charging voltage controllers 67K, 67Y, 67M, and 67C for black K, yellow Y, magenta M, and cyan C, and has a function to perform, by the instructions of the main controller 60, the control of applying the charging voltage V67 for uniformly charging the surfaces of the photosensitive drums 24 (=24K, 24Y, 24M, and 24C) to the charging rollers 25 (=25K, 25Y, 25M, and 25C), respectively.

The multiple head controllers 68 comprise, for example, head controllers 68K, 68Y, 68M, and 68C for black K, yellow Y, magenta M, and cyan C, and has a function to control, by the instructions of the main controller 60, the emissions of the exposure heads 29 (=29K, 29Y, 29M, and 29C) for exposing the surfaces of the photosensitive drums 24 (=24K, 24Y, 24M, and 24C) based on image data of the individual colors recorded in the image data editing memory 63. The multiple development voltage controllers 69 comprise, for example, development voltage controllers 69K, 69Y, 69M, and 69C for black K, yellow Y, magenta M, and cyan C, and has a function to perform, by the instructions of the main controller 60, the control of applying the development voltage V69 for developing electrostatic latent images on the surfaces of the photosensitive drums 24 (=24K, 24Y, 24M, and 24C) to the development rollers 22 (=22K, 22Y, 22M, and 22C), respectively.

The multiple blade voltage controllers 70 comprise, for example, blade voltage controllers 70K, 70Y, 70M, and 70C for black K, yellow Y, magenta M, and cyan C, and has a function to perform, by the instructions of the main controller 60, the control of applying the blade voltage V70 for controlling the charge amounts of toners on the development rollers 22 (=22K, 22Y, 22M, and 22C) to the development blades 23 (=23K, 23Y, 23M, and 23C), respectively.

The multiple supply voltage controllers 71 comprise, for example, supply voltage controllers 71K, 71Y, 71M, and 71C for black K, yellow Y, magenta M, and cyan C, and has a function to perform, by the instructions of the main controller 60, the control of applying the supply voltage V71 for supplying toners to the development rollers 22 (=22K, 22Y, 22M, and 22C) to the supply rollers 21 (=21K, 21Y, 21M, and 21C), respectively.

The multiple transfer voltage controllers 72 comprise, for example, transfer voltage controllers 72K, 72Y, 72M, and 72C for black K, yellow Y, magenta M, and cyan C, and has a function to perform, by the instructions of the main controller 60, the control of applying the transfer voltage V72 for transferring toner images of the photosensitive drums 24 (=24K, 24Y, 24M, and 24C) to the transfer rollers 34 (=34K, 34Y, 34M, and 34C), respectively.

The multiple image forming drive controllers 73 comprise, for example, image forming drive controllers 73K, 73Y, 73M, and 73C for black K, yellow Y, magenta M, and cyan C, and has a function to perform, by the instructions of the main controller 60, the control of rotationally driving drive motors 77 (=77K, 77Y, 77M, and 77C) that are the drive sources of the image forming units 10 (=10K, 10Y, 10M, and 10C). The rotations of the drive motors 77 (=77K, 77Y, 77M, and 77C) are transmitted to the photosensitive drums 24 (=24K, 24Y, 24M, and 24C), the development rollers 22 (=22K, 22Y, 22M, and 22C), and the supply rollers 21 (=21K, 21Y, 21M, and 21C). The charging rollers 25 (=25K, 25Y, 25M, and 25C) rotate following the photosensitive drums 24 (=24K, 24Y, 24M, and 24C).

The carrying controller 74 has a function to control, by the instructions of the main controller 60, driving a carrying motor 78 and an unshown clutch for rotationally driving the rollers (for example, the hopping roller 42, the registration roller pair 44 and 45, and the carrying roller pair 46 and 47) for feeding and carrying the recording medium 41. The belt drive controller 75 has a function to perform, by the instruction of the main controller 60, the control of driving a belt motor 79 that rotationally drives the belt drive roller 31 for having the carrying belt 33 run.

The fuser controller 76 controls, by the instructions of the main controller 60, turning ON/OFF a heater 51*a* built in the fuser roller 51 based on the detected temperature by a thermistor 80 provided in the fuser device 50 to keep the surface temperature of the fuser roller 51 at a constant temperature. The fuser controller 76 further has a function to control the driving of a fuser motor 81 for rotationally driving the fuser roller 51 in a state where the fuser device 50 reached a specified temperature. The fuser backup roller 52 rotates following the rotation of the fuser roller 51. The rotation of the fuser motor 81 is also transmitted to the ejection roller group 53 and 54.

Besides, if an up-down mechanism that raises/lowers the multiple image forming units 10 (=10K, 10Y, 10M, and 10C) is provided, an up-down motor for driving this up-down mechanism is provided.

(Basic operations in the image forming apparatus of Embodiment 1) The basic operations of the image forming apparatus 1 in this Embodiment 1 will be explained referring to FIGS. 1 through 3.

Upon receiving the print command and print data sent from the host device 59 through the I/F controller 61, the main controller 60 of the image forming apparatus 1 starts controlling a print operation (image formation) and issues instructions of the image formation to the multiple charging voltage controllers 67, the multiple head controllers 68, the multiple development voltage controllers 69, the multiple blade voltage controllers 70, the multiple supply voltage controllers 71, the multiple transfer voltage controllers 72, the multiple image forming drive controllers 73, the carrying controller 74, the belt drive controller 75, the fuser controller 76, etc. The main controller 60 temporarily stores the print data in the reception memory 62, performs an editing process of the stored print data to generate image data, and records them in the image data editing memory 63.

The carrying controller 74 drives the carrying motor 78 by following the instruction of the main controller 60. Thereby, the hopping roller 42 rotates and forwards, one piece at a time, the recording medium 41 stored in the sheet feeding cassette 40 to the medium carrying path 43. By the carrying motor 78, the registration roller pair 44 and 45 starts rotating at a specified timing and carries the recording medium 41 to the carrying roller pair 46 and 47 while correcting the skew of the recording medium 41. Further, by the carrying motor 78, the carrying roller pair 46 and 47 rotates and carries the recording medium 41 along the medium carrying path 43 to the carrying belt 33.

The belt drive controller 75 drives the belt motor 79 by following the instruction of the main controller 60. Thereby, the belt drive roller 31 rotates, and the carrying belt 33 runs and adsorb-holds and carries the recording medium 41 through the image forming units 10 (=10K, 10Y, 10M, and 10C) of individual colors in that order.

The image forming units 10 (=10K, 10Y, 10M, and 10C) of individual colors perform the formation of toner images of individual colors by following the instructions of the main controller 60. That is, by the charging voltage controllers 67 (=67K, 67Y, 67M, and 67C), the development voltage controllers 69 (=69K, 69Y, 69M, and 69C), the blade voltage controllers 70 (=70K, 70Y, 70M, and 70C), and the supply voltage controllers 71 (=71K, 71Y, 71M, and 71C) of individual colors, the charging voltage V67, the development voltage V69, the blade voltage V70, and the supply voltage V71 are applied respectively to the charging rollers 25 (=25K, 25Y, 25M, and 25C), the development rollers 22 (=22K, 22Y, 22M, and 22C), the development blades 23 (=23K, 23Y, 23M, and 23C), and the supply rollers 21 (=21K, 21Y, 21M, and 21C).

By following the instructions of the main controller 60, the image forming drive controllers 73 (=73K, 73Y, 73M, and 73C) of individual colors drive the drive motors 77 (=77K, 77Y, 77M, and 77C) of individual colors to rotate the photosensitive drums 24 (=24K, 24Y, 24M, and 24C) of individual colors. Accompanying the rotations of the photosensitive drums 24 (=24K, 24Y, 24M, and 24C) of individual colors, the charging rollers 25 (=25K, 25Y, 25M, and 25C), the development rollers 22 (=22K, 22Y, 22M, and 22C), and the supply rollers 21 (=21K, 21Y, 21M, and 21C) of individual colors also rotate. The charging rollers 25 (=25K, 25Y, 25M, and 25C) of individual colors uniformly charge the surfaces of the photosensitive drums 24 (=24K, 24Y, 24M, and 24C) of individual colors.

Based on image data recorded in the image data editing memory 63, the main controller 60 instructs the head controllers 68 (=68K, 68Y, 68M, and 68C) of individual colors to perform emission controls. The head controllers 68 (=68K, 68Y, 68M, and 68C) of individual colors irradiate the surfaces of the photosensitive drums 24 (=24K, 24Y, 24M, and 24C) of individual colors with light from the exposure heads 29 (=29K, 29Y, 29M, and 29C) of individual colors to form electrostatic latent images.

The electrostatic latent images formed on the surfaces of the photosensitive drums 24 (=24K, 24Y, 24M, and 24C) of individual colors are developed with toners adhering to the development rollers 22 (=22K, 22Y, 22M, and 22C) of individual colors, respectively, and toner images are formed respectively on the surfaces of the photosensitive drums 24 (=24K, 24Y, 24M, and 24C) of individual colors. When the toner images come close to the surface of the carrying belt 33 by the rotations of the photosensitive drums 24 (=24K, 24Y, 24M, and 24C) of individual colors, the transfer voltage controllers 72 (=72K, 72Y, 72M, and 72C) of individual colors apply the transfer voltage V72 to the transfer rollers 34 (=34K, 34Y, 34M, and 34C) of individual colors, respectively. Thereby, the toner images formed respectively on the surfaces of the photosensitive drums 24 (=24K, 24Y, 24M, and 24C) of individual colors are transferred to the recording medium 41 on the carrying belt 33.

Toners on the surfaces of the photosensitive drums 24 (=24K, 24Y, 24M, and 24C) of individual colors that were not transferred to the recording medium 41 are scraped off by the cleaning blades 26 (=26K, 26Y, 26M, and 26C) of individual colors, respectively.

In this manner, the toner images of individual colors formed on the image forming units 10 (=10K, 10Y, 10M, and 10C) of individual colors are sequentially transferred to the recording medium 41 and superimposed with one another. The recording medium 41, to which the toner images of individual colors are transferred, is further carried by the carrying belt 33 and reaches the fuser device 50.

In the fuser device 50, the recording medium 41 is introduced to the NIP part between the fuser roller 51 and the fuser backup roller 52. The recording medium 41 is pressed and heated in the NIP part between the fuser roller 51 and the fuser backup roller 52, and the toner images are fused to the recording medium 41. The recording medium 41 with the toner images fused is ejected by the ejection roller group 53 and 54 to the outside of the image forming apparatus 1 and stacked on the stacker part 3. Thereby, the formation of a color image onto the recording medium 41 is complete.

As mentioned above, the cleaning blades 26 (=26K, 26Y, 26M, and 26C) of individual colors come into contact with the surfaces of the photosensitive drums 24 (=24K, 24Y, 24M, and 24C) of individual colors and scratch off the transfer residual toners adhering to the surfaces of these photosensitive drums 24 (=24K, 24Y, 24M, and 24C) of individual colors.

In recent image forming apparatuses, the reduction of the particle size and lowering of the melting point of toners have been progressing for the purpose of improving the image quality and increasing the speed. Toners having smaller particle sizes and lower melting points tend to contain more external additives (for example, silica fine particles, charge control agents, etc.). The reason for this is, for example, that in order to charge the toner within a short period of time, the amount of the charge control agent contained in the toner must be increased to stabilize the toner charge. If the amount of external additives increases in this manner, the external additives could pass through the NIP parts of the cleaning blades 26 (=26K, 26Y, 26M, and 26C) of individual colors and the photosensitive drums 24 (=24K, 24Y, 24M, and 24C) of individual colors, adhere to the surfaces of the charging rollers 25 (=25K, 25Y, 25M, and 25C) of individual colors, and influence the image formation.

Then, in this Embodiment 1, adherence of the external additives to the charging rollers 25 is prevented by performing the below-mentioned charging roller cleaning sequence where the charging voltage V67 of the charging rollers 25 at the non-image forming time is made larger than that at the image forming time.

Incidentally, if the charging voltage V67 of the charging rollers 25 is increased at the image forming time, the intermediate-tone density becomes hard to be realized, and the photosensitive drum surface potential becomes always high, thereby the adhering force of the external additives to the photosensitive drums 24 becomes larger. Therefore, the amount of the external additives slipping through the cleaning blades increases. For example, if the charging voltage V67 of the charging rollers 25 at the image forming time is increased from −1000 V to −1200 V, the surface potential of the photosensitive drums 24 changes from −500 V to −700 V. Because the surface potential of the photosensitive drums 24 is high, it becomes easier for the external additives of the opposite polarity to the toners inside the development units 20 (that is, the positively-charged external additives) to move to the photosensitive drums 24. Therefore, because the supply amount of the external additives to the cleaning blades 26 increases, the probability for the external additives to slip through increases, and the adhesion of the external additives to the charging rollers 25 could worsen. In this manner, because simply increasing the charging voltage V67 at the image forming time cannot prevent the external additives from adhering to the charging rollers 25, the charging roller cleaning sequence of this Embodiment 1 explained below needs to be performed.

Charging Roller Cleaning Sequence of Embodiment 1

Figure 4:
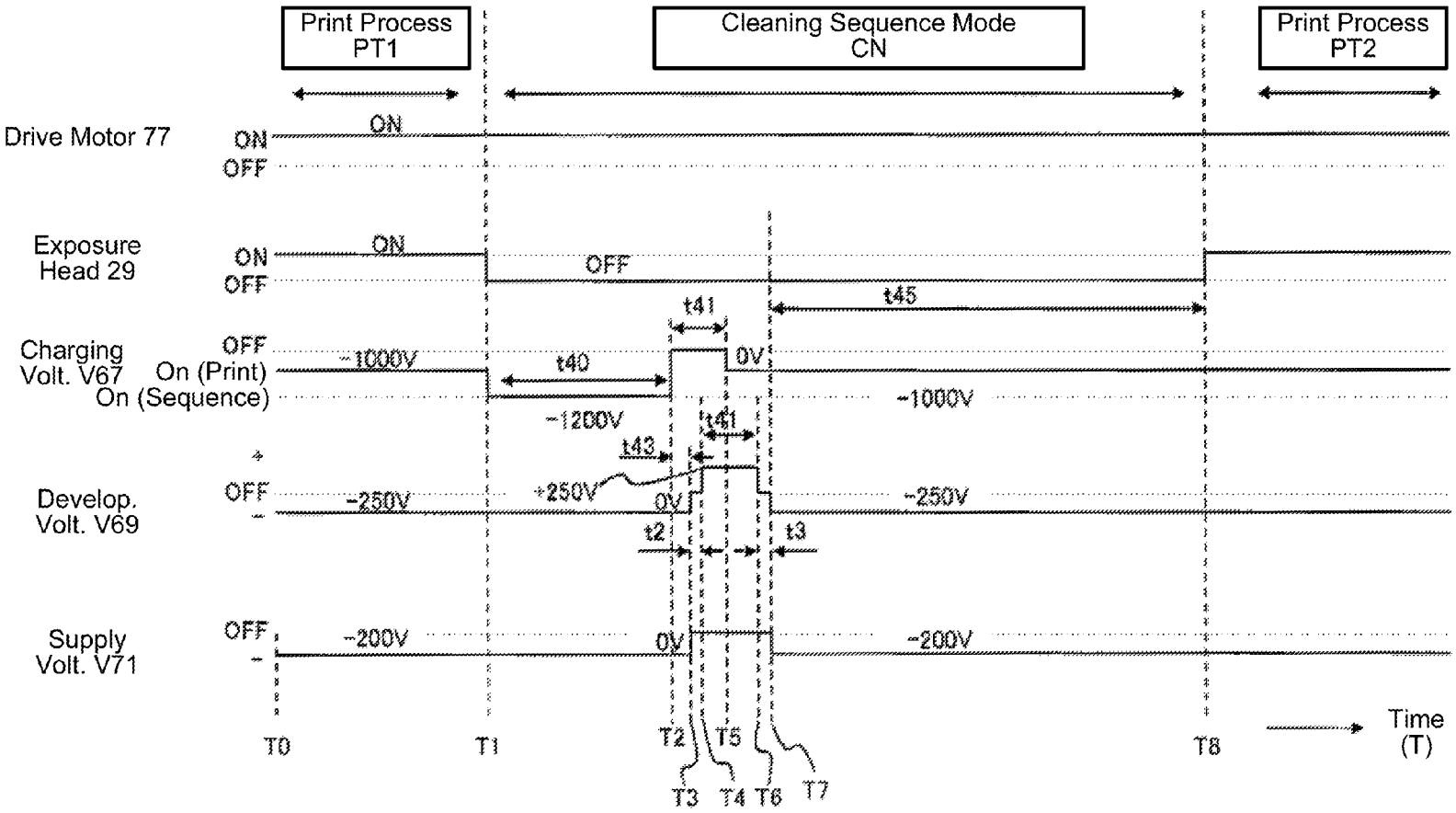
FIG. 4 is a time chart showing the charging roller cleaning sequence mode at every print job in the image forming units 10 in Embodiment 1.

FIG. 4 is a time chart showing the charging roller cleaning sequence mode at every print job in the image forming units 10 of Embodiment 1. The horizontal axis of FIG. 4 is time T, and the vertical axis is the ON/OFF states of motors, etc.

The charging roller cleaning sequence mode will be explained using FIG. 4. Besides, because the image forming units 10 (=10K, 10Y, 10M, and 10C) of individual colors have the same control method, having no differences due to color, the following explanations will be given in the image forming unit 10 as a representative.

In the time chart in FIG. 4, the interval from time T0 through T1 is a print process PT1 (or image forming mode), the interval from time T1 through T8 (=T1, T2, T3, T4, T5, T6, T7, and T8) is the period of the cleaning sequence mode CN, and the interval after time T8 is a next print process PT2. In the specification, ON state of the drive motor 77 means a state where the motor is driving. OFF state of the drive motor 77 means a state where the motor is not driving (or stops). ON state of the exposure head 29 means a state where the head is exposing the surface of photosensitive drum with light. OFF state of the exposure head 29 means a state where the head does not emit light.

In the print process PT1 from T0 through T1, the main controller 60 instructs the charging voltage controller 67, the head controller 68, the development voltage controller 69, the blade voltage controller 70, the supply voltage controller 71, the transfer voltage controller 72, the image forming drive controller 73, the carrying controller 74, the belt drive controller 75, and the fuser controller 76 to have an image formation executed for printing a toner image on the recording medium 41.

At this time, the drive motor 77 that is the drive source of the image forming unit 10 is turned ON by the control of the image forming drive controller 73, and the exposure head 29 for exposing the surface of the photosensitive drum 24 is turned ON by the control of the head controller 68. Further, the charging voltage V67 applied to the charging roller 25 is set to, for example, −1000 V by the control of the charging voltage controller 67, the development voltage V69 applied to the development roller 22 is set to, for example, −250 V by the control of the development voltage controller 69, and the supply voltage V71 applied to the supply roller 21 is set to, for example, −200V by the control of the supply voltage controller 71.

Once the print job of the print process PT1 is finished, it proceeds to the cleaning sequence mode CN from time T1 through T8.

At time T1, the exposure head 29 is turned OFF by the control of the head controller 68. Further, the charging voltage V69 applied to the charging roller 25 is changed, for example, from −1000 V to −1200 V by the control of the charging voltage controller 67. Although this voltage value is merely an example, the absolute value of the charging voltage V67 (=1200 V) at the time of the cleaning sequence mode CN must be larger than the absolute value of the charging voltage V67 (=−1000 V) at the time of the print process PT1. This is because, as mentioned later, the external additives adhering to the charging roller 25 can be more efficiently removed when the surface potential of the photosensitive drum 24 is higher. Therefore, the reason for making the absolute value of the charging voltage V67 at the time of the cleaning sequence mode CN larger than the absolute value of the charging voltage V67 at the time of the print process PT1 is for removing the external additives adhering to the charging roller 25 within a short period of time without significantly decreasing the print throughput (the amount of processed job per unit time).

During a time period t40 from time T1 through T2, the photosensitive drum 24 is driven at the charging voltage V67 (=−1200 V) of the cleaning sequence mode CN. The time period t40 is time for driving the photosensitive drum 24 by 28 mm corresponding to three rotations. For example, although the time period t40 is 1.4 seconds, this value is merely an example and can be any time period that allows the surface of the photosensitive drum 24 to be sufficiently charged.

During the time period t40, because the potential of the charging roller 25 is higher than the surface potential of the photosensitive drum 24, the external additives of the opposite polarity to that of the toner T adhering to the charging roller 25 remain on the charging roller 25. For example, while the surface potential of the photosensitive drum 24 is −700 V, that of the charging roller 25 is −1200 V. Therefore, the positively-charged external additives remain on the charging roller 25 that is more negatively charged than the photosensitive drum 24.

After the surface potential of the photosensitive drum 24 has sufficiently become the surface potential of the cleaning sequence mode CN (that is, after the photosensitive drum 24 has been driven for the time period of t40), at time T2, the charging voltage V67 applied to the charging roller 25 is turned OFF (that is, 0 V). Thereby, because the surface potential of the photosensitive drum 24 becomes larger in the negative side than the potential of the charging roller 25, the external additives of the opposite polarity to that of the external additives adhering to the charging roller 25 (the external additives of the opposite polarity to that of the toner T, that is, it becomes easier for the positively-charged external additives) to move onto the photosensitive drum 24. For example, because the potential of the charging roller 25 is 0 V while the surface potential of the photosensitive rum 24 is −700 V, the positively-charged external additives adhering to the charging roller 25 move to the photosensitive drum 24 by the potential difference (=700 V). Thereby, the external additives adhering to the charging roller 25 are removed. Also, it is seen that the larger the potential difference (=700 V) is, the easier it becomes for the positively-charged external additives to move to the photosensitive drum 24.

The OFF period of the charging voltage V67 applied to the charging roller 25 is maintained during the time period t41 from time T2 through T5. The time period t41 corresponds to the external additive cleaning period of the charging roller 25. The time period t41 is set to time for driving the charging roller 25 by 125 mm corresponding to two rotations. For example, although the time period t41 is 0.6 seconds, this is merely an example, and in order to clean the whole circumference evenly, the time period t41 should preferably a time period that allows driving the charging roller 25 by an integer times of its diameter.

Incidentally, during a time period t43 since the charging voltage V67 applied to the charging roller 25 is turned OFF at time T2 until time T3, the photosensitive drum 24 rotates, and further, after a time period t2 from time T3 through T4 passed, a voltage of the opposite polarity to that at the time of the print process PT1 is applied as the development voltage V69 applied to the development roller 22. For example, as the development voltage V69 applied to the development roller 22 at the time of the print process PT1, +250 V is applied as opposed to −250 V. The time period t43 is drive distance time between the NIP part of the photosensitive drum 24 and the charging roller 25 and the NIP part of the photosensitive drum 24 and the development roller 22, and the time period t2 is high voltage switching time. For example, the time period t43 is time (=0.25 seconds) for driving by 50 mm, and the time period t2 is set to 0.04 seconds. The values of the time periods t43 and t2 are merely examples, and also, the time period t2 should ideally 0 second. Besides, the reason for applying a voltage of the opposite polarity to that at the time of the print process PT1 as the development voltage V69 applied to the development roller 22 is to prevent securely the toner T on the development roller 22 from moving to the photosensitive drum 24 and to prevent the external additives that migrated from the charging roller 25 to the photosensitive drum 24 from being recovered by the development roller 22.

At the same time as the timing to apply the development voltage V69 of the opposite polarity to that at the time of the normal print process PT1 to the development roller 22 (although this timing is time T4 to be precise, to secure some margin, the timing of time T3 to turn OFF the development voltage V69), the supply voltage V71 applied to the supply roller 21 is also turned OFF. This is for not supplying the toner T to the development roller 22 and preventing the external additives charged with the reverse polarity from moving to the development roller 22 side. For example, as opposed to the supply voltage V71 (=−200 V) applied to the supply roller 21, the supply roller 21 is 0 V. Therefore, the positively-charged external additives easily move to the supply roller 21 side. Therefore, the external additives inside the development unit 20 are not newly supplied from the development roller 22 to the photosensitive drum 24.

Incidentally, the external additives that moved from the charging roller 25 to the photosensitive drum 24 during the OFF period of the charging voltage V67 applied to the charging roller 25 (that is, during the time period t41 from time T2 through T5) are carried in the direction of an arrow in FIG. 2 accompanying the driving of this photosensitive drum 24. Because the development voltage V69 of the positive polarity is applied to the development roller 22 as mentioned above, the carried external additives are not recovered by the development roller 22 but pass as they are, and move to the NIP part of the cleaning blade 26 and the photosensitive drum 24. Because the external additives are scraped off by the cleaning blade 26, there is almost no chance that they will return to the charging roller 25 again.

After time T5 when the OFF period (=the time period t41) of the charging voltage V67 applied to the charging roller 25 ended, as the charging voltage V67 applied to that charging roller 25, the same voltage (=−1000 V) as that at the time of the print process PT1 is applied again. This is for stabilizing the surface potential of the photosensitive drum 24 in preparation for the next print job.

In the same manner, as the development voltage V69 applied to the development roller 22 and the supply voltage V71 applied to the supply roller 21, the same voltages (V69=−250 V, V71=−200 V) as those at the time of the print process PT1 are also applied at the stage (time T7) when the OFF period (=the time period t41) of the charging voltage V67 applied to the charging roller 25 ended. As to the development roller 22, after the time period t3 from time T6 through T7, the same development voltage V69 (=−250 V) as that at the time of the print process PT1 is applied, and the time period t3 is voltage switching time, that is ideally 0 second. Here, the time period t3 is set to 0.04 seconds.

This application of the same development voltage V69 (=−250 V) and supply voltage V71 (=−200 V) as those at the time of the print process PT1 is maintained during the time period t45 from time T7 through T8. The time period t45 is time necessary for stabilizing the toner layer potential. Here, the time period t45 is set to time to drive by 200 mm that corresponds to twice the total circumference length of the development roller 22 and the supply roller 21 added up. For example, although the time period t45 is 1 second, this is merely an example, and it can be any minimum period of time for the toner layer potential to be stabilized.

Here, the cleaning sequence mode CN from time T1 through T8 is finished. If there is a next print job, the print process PT2 is implemented from time T8, and if there is no next print job, the driving of the image forming unit 10 is stopped.

(Efficacy of Embodiment 1) According to this Embodiment 1, after the print process (image formation) based on a print job is finished, the cleaning sequence mode CN of the charging roller 25 is implemented, and in this cleaning sequence mode CN, the charging voltage V67 applied to the charging roller 25 is made larger than the application voltage at the time of the print process (at the time of the image formation). Thereby, it becomes possible to remove the external additives adhering to the charging roller 25 without decreasing the print throughput. Therefore, the charge unevenness of the surface of the charging roller 25 due to the adhering external additives is dissolved, and the photosensitive drum 24 is evenly charged, enabling the formation of fine images.

Embodiment 2

Configuration of Embodiment 2

The image forming apparatus 1 in Embodiment 2 of this invention has the same configuration as in Embodiment 1, and the control method of the charging roller cleaning sequence is different from that in Embodiment 1.

Charging Roller Cleaning Sequence of Embodiment 2

In the above-mentioned Embodiment 1, improvement of the image quality is attempted by implementing the cleaning sequence mode CN after a print job is finished (that is, after the print process PT1 is finished). As opposed to this, in this Embodiment 2, by executing the cleaning sequence mode CN only in an environment where the external additives easily adhere to the charging roller 25, even further improvement in the print throughput is aimed at. Specifically, because the toner T is easily charged in a low-humidity situation, the external additives easily peel off the toner T.

Figure 5:
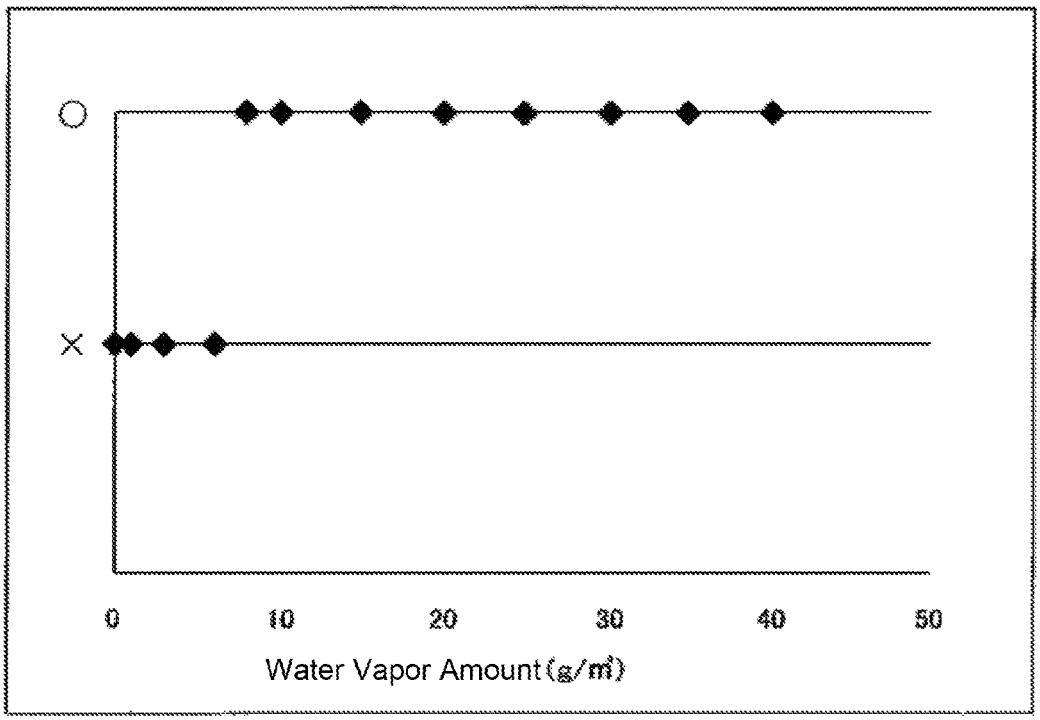
FIG. 5 is a chart showing the relationship between the water vapor amount in the ambient environment and the external additives adhering state to the charging rollers 25.

FIG. 5 is a plot showing the relationship between the water vapor amount in the ambient environment and the external additives adhering state to the charging roller 25. In the specification, the ambient environment means an air condition of a room where the image forming apparatus is installed, which is determined by a water vapor amount, a room temperature, humidity, or the combination thereof.

The horizontal axis in FIG. 5 shows the water vapor amount ($g/m^3$). The vertical axis in FIG. 5 shows the external additives adhering state, where the cases with no external additives observed adhering to the surface of the charging roller 25 are indicated as ○, and the cases with the external additives observed adhering to the surface of the charging roller 25 are indicated as X. From this FIG. 5, it is seen that the smaller the water vapor amount is, the more adherence of the external additives occurs. This is because the water content agglomerates in the contact section between the external additives and the toner T, generating a liquid bridge force, it becomes hard for the external additives to be dislocated from the toner T. Thereby, it is believed that the more the water vapor amount is, the more difficult it is for the external additives to be dislocated. Therefore, in this Embodiment 2, in an environment where the water vapor amount is small, the cleaning sequence mode CN is executed.

Figure 6:
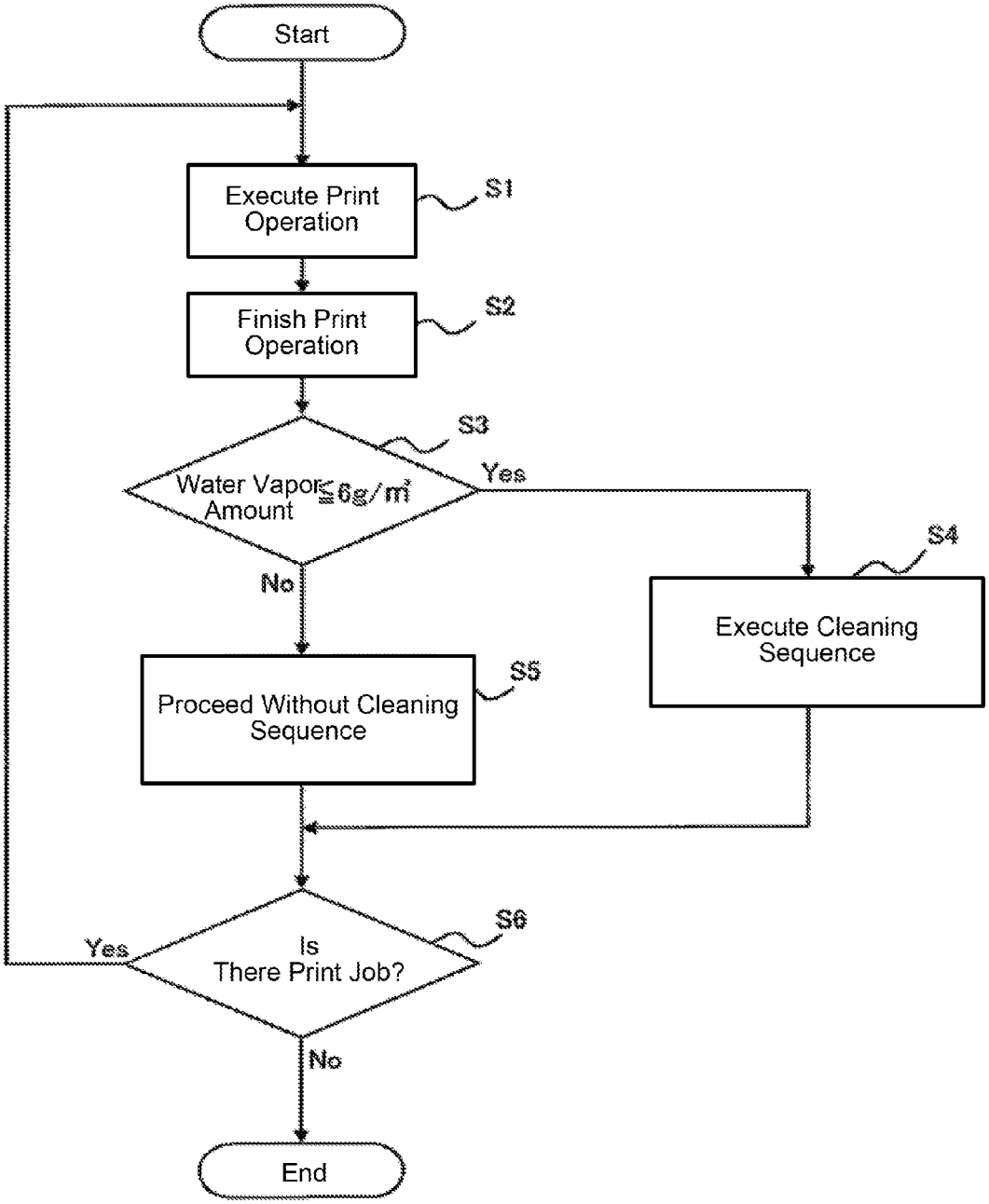
FIG. 6 is a flow chart showing the processes of the cleaning sequence mode CN in Embodiment 2.

FIG. 6 is a flow chart showing the processes of the cleaning sequence mode CN in Embodiment 2.

Once the cleaning sequence mode CN in FIG. 6 is started, at S1 the print operation is executed by the control of the main controller 60 in FIG. 3. When the print operation is finished at S2, it proceeds to S3. At S3, based on the result of ambient temperature and humidity detected by the temperature and humidity sensor 66*b* in the sensor group 66 in FIG. 3, the main controller 60 computes the amount of ambient water vapor and judges whether this water vapor amount is 6 $g/m^3$ or less. If the judgment condition of 6 $g/m^3$ or less is satisfied (Yes), it proceeds to S4, and if not satisfied, it proceeds to S5.

At S4, following the instructions of the main controller 60, by the control of the head controller 68, the charging voltage controller 67, the development voltage controller 69, and the supply voltage controller 71, the cleaning sequence mode CN is executed, and it proceeds to S6. At S5, following the instructions of the main controller 60, it proceeds to S6 without executing the cleaning sequence mode CN. At S6 the main controller 60 judges whether there is a next print job (print process) or not. If there is a next print job (Yes), it returns to S1, and if there is no next print job (No), the process of the cleaning sequence mode CN is finished.

Besides, in the flow chart in FIG. 6, although the explanation was given for the case where the cleaning sequence mode CN is executed at the water vapor amount of 6 $g/m^3$ or less, depending on the cleaning blade setup or material, the environment (water vapor amount) that likely occurs may differ. What were shown in the processes in FIG. 6 are merely an example, and the environment to execute the cleaning sequence mode may be changed according to the cleaning blade 26.

Efficacy of Embodiment 2

According to this Embodiment 2, because the cleaning sequence mode CN is executed only in a specific environment (that is, in a low-humidity situation where the amount of ambient water vapor is small and the external additives easily adhere to the charging roller 25), the external additives adhering to the charging roller 25 can be easily cleaned. Therefore, it becomes possible to charge the photosensitive drum 24 evenly without decreasing the print throughput.

Especially, in this Embodiment 2, because the amount of ambient water vapor is computed based on the result of detecting ambient temperature and humidity by the temperature and humidity sensor 66*b* to judge whether to implement or not to implement the cleaning sequence mode CN with this water vapor amount as the reference, the judgment of implementation/non-implementation can be performed simply and accurately, allowing further improvement of the print throughput.

Embodiment 3

Configuration of Embodiment 3

The image forming apparatus 1 in Embodiment 3 of this invention has the same configuration as in Embodiment 1, and the control method of the charging roller cleaning sequence is different from that in Embodiment 2.

Charging Roller Cleaning Sequence of Embodiment 3

In the above-mentioned Embodiments 1 and 2, the cleaning sequence mode CN is executed at the completion of the print job (completion of the print process). As opposed to this, in this Embodiment 3, for example, the cleaning sequence mode CN is executed after performing printing of a specified number of pieces in such a case that a large number of pieces are continuously printed in one print job. Thereby, it becomes possible to remove more efficiently the external additives adhering to the charging roller 25.

Figure 7:
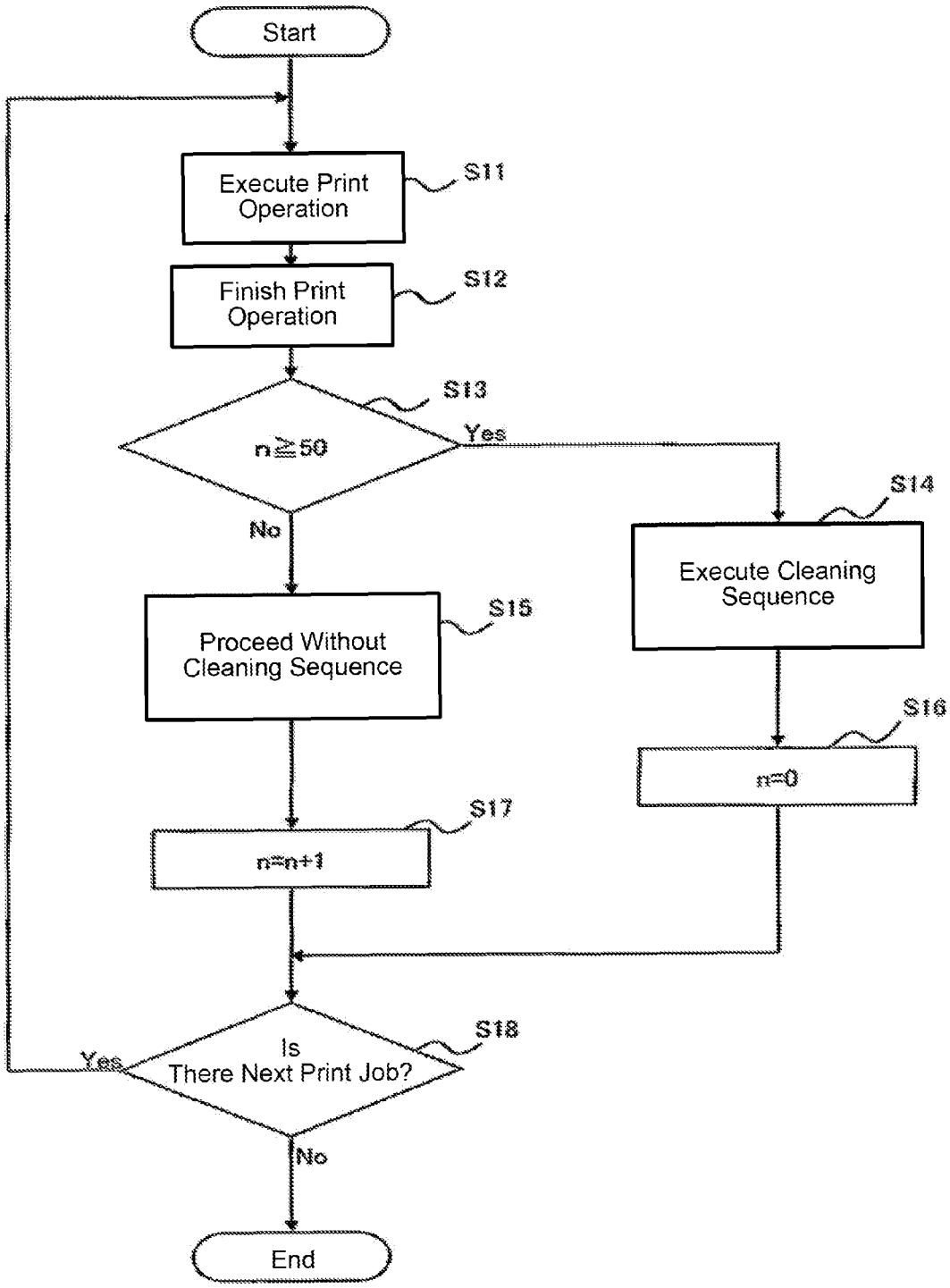
FIG. 7 is a flow chart showing the processes of the cleaning sequence mode CN in Embodiment 3.

FIG. 7 is a flow chart showing the processes of the cleaning sequence mode CN in Embodiment 3.

Once the cleaning sequence mode CN in FIG. 7 is started, at S11, the print operation is executed by the control of the main controller 60 in FIG. 3. At S12, once the print operation is finished, it proceeds to S13. At S13, the main controller 60 judges whether a cleaning sequence count n written in this internal RAM is equal to or larger than a prescribed number (for example, n≥50) or not. The cleaning sequence count n is counted by a counting means as a computing means provided in the main controller 60. If the judgment result at S13 is equal to or larger than the prescribed number (Yes), it proceeds to S14, and if smaller than the prescribed number (No), it proceeds to S15.

At S14, following the instructions of the main controller 60, by the control of the head controller 68, the charging voltage controller 67, the development voltage controller 69, and the supply voltage controller 71, the cleaning sequence mode CN is executed, and it proceeds to S16. At S15, following the instruction of the main controller 60, it proceeds to S17 without executing the cleaning sequence mode CN.

At S16, the main controller 60 rewrites the cleaning sequence count n written in the internal RAM to 0, and proceeds to S18. At S17, the main controller 60 rewrites the cleaning sequence count n written in the internal RAM to a value that is the current value incremented by 1, and proceeds to S18. At S18, the main controller 60 judges whether there are next print data or not. If there are next print data (Yes), it returns to S11, and if there are no next print data (No), it ends the process of the cleaning sequence mode CN.

Besides, in the flow chart in FIG. 7, although executing the cleaning sequence mode CN is allowed at every 50 pieces printed as an example, it may be freely chosen at every how many pieces to execute the cleaning sequence mode CN according to the properties of the image forming unit 10 while the effect increases the more often the cleaning sequence is executed at a stage where a smaller number of pieces are printed.

Efficacy of Embodiment 3

According to this Embodiment 3, because the cleaning sequence mode CN is executed even during a print job that prints a large quantity, without depending on the print job, the external additives adhering to the charging roller 25 can be periodically cleaned. Therefore, it becomes possible to charge the photosensitive drum 24 evenly in a stable manner.

Modifications of Embodiments 1 Through 3

This invention is not limited by the above-mentioned Embodiments 1 through 3, but various kinds of modes of use and modifications are possible. Examples of these modes of use or modifications are (a) and (b) below.

(a) The image forming apparatus 1 in FIGS. 1 and 2 and its control system in FIG. 3 allow modifications such as adding components other than those shown in the figures or deleting them. For example, in the control system in FIG. 3, the I/F controller 61, the reception memory 62, and the image data editing memory 63 may be provided in the main controller 60.

(b) In Embodiments 1 through 3, although a color printer was explained as an example of the image forming apparatus 1, this invention is not limited to color printers. This invention can be applied to image forming apparatuses such as facsimile machines, copiers, monochrome printers, and MFPs (MultiFunction Peripherals) that form an image on a recording medium using an electrophotographic system or the like.

What is claimed is:

1. An image forming apparatus, comprising:

an image carrier that carries, on its surface, a developer image formed by a developer including external additives, a charging member to which a charging voltage is applied for charging the surface of the image carrier, a developer carrier that carries the developer and to which a development voltage is applied for forming the developer image on the surface of the image carrier, a developer supply member to which a supply voltage is applied for supplying the developer to the developer carrier, a main controller that controls an image formation mode for developing the developer image on a recording medium and controls a cleaning sequence mode that is other than the image formation mode and cleans the charging member, and a voltage controller that changes outputs of the charging voltage, the development voltage and the supply voltage, and executes the cleaning sequence mode based on instructions of the main controller, wherein when executing the cleaning sequence mode, the voltage controller makes an absolute value of the charging voltage larger than that in the image forming mode, and afterwards sets the output of the charging voltage to an OFF state, and the voltage controller performs another voltage output control that is a process in which a polarity of the development voltage in the cleaning sequence mode is made opposite to that in the image forming mode, and the output of the supply voltage is set to the OFF state.

2. The image forming apparatus according to claim 1, wherein the voltage controller sets the output of the charging voltage to the OFF state and moves the external additives, which adhere onto the charging member and have an opposite polarity to that of the developer, to the image carrier by a voltage difference between the charging member and the image carrier.

3. The image forming apparatus according to claim 1, wherein the voltage controller performs a voltage output control that is a process in which, after setting an absolute value of a surface voltage of the image carrier charged by the charging member in the cleaning sequence mode larger than that in the image forming mode, the charging voltage is set to zero volt.

4. The image forming apparatus according to claim 1, wherein the developer is a nonmagnetic one-component developer comprising mother particles containing a resin and a coloring agent and the external additives added to the mother particles, an average particle size of the external additives is within a range of 5-400 nm, and an addition amount of the external additives per 100 pts. wt. of the mother particles is within a range of 0.5-8.0 pts. wt.

5. The image forming apparatus according to claim 1, further comprising:

a detection part that detects a print environment and outputs a result of the print environment that is detected, wherein the main controller controls the cleaning sequence mode based on the result of the print environment.

6. The image forming apparatus according to claim 5, wherein the detection part detects a water vapor amount of an ambient environment with respect to the image forming apparatus, the result of the print environment is the water vapor amount, and the main controller instructs the voltage controller to execute the cleaning sequence mode when the water vapor amount is smaller than a specified value.

7. The image forming apparatus according to claim 6, wherein the ambient environment is defined by a temperature and a humidity of a room in which the image forming apparatus is installed, the water vapor amount is determined by the temperature and the humidity.

8. The image forming apparatus according to claim 7, wherein the detection part is a temperature and humidity sensor.

9. The image forming apparatus according to claim 1, wherein the main controller comprises a computing part that computes the number of printed pieces and outputs the result of a number of printed pieces that is counted, and the main controller instructs the voltage controller to execute or not to execute the cleaning sequence mode based on the result of the number of printed pieces.

10. The image forming apparatus according to claim 9, wherein the main controller instructs the voltage controller to execute the cleaning sequence mode when a result of the number of printed pieces is larger than a prescribed value, and instructs the voltage controller not to execute the cleaning sequence mode when a result of computing the number of printed pieces is smaller than the prescribed value.

11. The image forming apparatus according to claim 9, wherein the computing part is a counting means.

12. The image forming apparatus according to claim 1, wherein the image carrier is a photosensitive drum, the charging member is a charging roller, the developer carrier is a development roller, and the developer supply member is a supply roller.

13. An image forming apparatus that includes a controller for controlling a development voltage supplied to a developer carrier for developing a latent image on an image carrier with developer that includes external additives, a supply voltage that is used to charge the developer to be supplied to the image carrier and a charging voltage that is used for cleaning the surface of the image carrier, comprising:

the controller executing an image formation mode and a cleaning sequence mode by switching between them so that only one of which is performed at once, wherein in the image formation mode, polarities of the development voltage, supply voltage and charging voltage are the same as a polarity of the developer, the developer having an opposite polarity from that of the external additives, and in the cleaning sequence mode, the controller sets an absolute value of the charging voltage to be greater than at the image forming sequence mode, then the controller rotates the image carrier more than one rotation so as to charge the image carrier with the charging voltage, then the controller sets the development voltage, supply voltage and charging voltage to OFF state which is ranged from −10 Volt to +10 Volt, then while the charging member maintains the OFF state, the controller rotates the image carrier more than one rotation so that the external additives on the charging member are moved to the image carrier due to a potential difference between the charging member and the image carrier.

14. An image forming apparatus, comprising:

an image carrier that carries on a surface thereof a developer image formed with a developer having external additives;

a charging member to which a charging voltage is applied for charging the surface of the image carrier;

a developer carrier that carries the developer and to which a development voltage is applied for forming the developer image on the surface of the image carrier that has been charged with the charging voltage;

a developer supply member to which a supply voltage is applied for supplying the developer to the developer carrier;

a main controller that controls the image forming apparatus in an image formation mode for printing the develop image on a recording medium, and a cleaning sequence mode for removing the external additives on the charging member; and a voltage controller that changes values of the charging voltage, the development voltage and the supply voltage based on an instruction from the main controller, wherein in the cleaning sequence mode, the voltage controller:

sets an absolute value of the charging voltage larger than an absolute value of the charging voltage applied in the image formation mode, and subsequently sets the absolute value of the charging voltage smaller than the absolute value of the charging voltage applied in the image formation mode, sets the value of the development voltage to a value different from the value of the development voltage applied in the image formation mode, and sets the value of the supply voltage to a value different from the value of the supply voltage applied in the image formation mode.

15. The image forming apparatus according to claim 14, wherein in the cleaning sequence mode, the voltage controller:

sets the absolute value of the charging voltage larger than the absolute value of the charging voltage applied in the image formation mode and afterwards sets an output of the charging voltage to an OFF state, and sets an output of the supply voltage to the OFF state.

16. The image forming apparatus according to claim 15, wherein polarities of the charging voltage, the development voltage and the supply voltage applied in the image formation mode are the same as a polarity of the developer.

17. The image forming apparatus according to claim 14, wherein in the cleaning sequence mode, the voltage controller sets the development voltage with a polarity that is opposite from a polarity of the development voltage applied in the image formation mode.

18. The image forming apparatus according to claim 14, wherein in the cleaning sequence mode, the image carrier is rotated for multiple rotations during a period of time in which the absolute value of the charging voltage is set greater than the absolute value of the charging voltage applied in the image formation mode, and a period of time in which the absolute value of the charging voltage is set smaller than the absolute value of the charging voltage applied in the image formation mode.

19. The image forming apparatus according to claim 14, wherein in the cleaning sequence mode, the voltage controller:

sets the absolute value of the charging voltage larger than the absolute value of the charging voltage applied in the image formation mode and afterwards sets the absolute value of the charging voltage smaller than the absolute value of the charging voltage applied in the image formation mode, and afterwards sets the value of the charging voltage the same as the value of the charging voltage applied in the image formation mode, sets a polarity of the development voltage opposite from a polarity of the development voltage applied in the image formation mode, and afterwards sets the polarity of the development voltage the same as the polarity of the development voltage applied in the image formation mode, and sets an output of the supply voltage to an OFF state, and afterwards sets the value of the supply voltage the same as the value of the supply voltage applied in the image formation mode.

* * * * *